United States Patent [19]

Yoshinari et al.

[11] Patent Number: 4,825,813

[45] Date of Patent: May 2, 1989

[54] MULTI-PIPE ONCE-THROUGH TYPE BOILER

[75] Inventors: Yuji Yoshinari, Hojo; Hitoshi Shiraishi, Matusyama; Osamu Tanaka, Matsuyama; Akiyoshi Kawahito, Matsuyama; Toshihiro Kayahara, Matsuyama; Satoru Takeda, Matsuyama; Takashi Yamada, Matsuyama; Akinori Kawakami, Matsuyama, all of Japan

[73] Assignee: Miura Co., Ltd., Matsuyama, Japan

[21] Appl. No.: 96,673

[22] Filed: Oct. 23, 1987

Related U.S. Application Data

[63] Continuation of Ser. No. 852,617, Apr. 16, 1986, abandoned.

[30] Foreign Application Priority Data

Jan. 31, 1986 [JP] Japan ..... 61-20481

[51] Int. Cl.[4] ..... F22B 7/00

[52] U.S. Cl. ..... 122/6 A; 165/182; 122/367 R; 122/136 R; 122/13 R

[58] Field of Search ..... 122/6 A, 16, 13 R, 18, 122/155 A, 235 A, 135 F, 153, 235 F, 367 R, 367 C; 165/180, 160, 133, DIG. 11

[56] References Cited

U.S. PATENT DOCUMENTS

| | | | |
|---|---|---|---|
| 2,540,339 | 2/1951 | Kritzer . | |
| 2,570,073 | 10/1951 | Prentiss . | |
| 2,660,155 | 11/1953 | Chapman . | |
| 2,712,438 | 7/1955 | Brown, Jr. . | |
| 2,737,370 | 3/1956 | Frisch et al. . | |
| 2,775,431 | 12/1956 | Krassowski . | |
| 3,260,652 | 7/1965 | Ritz et al. . | |
| 3,311,091 | 3/1967 | Kollerup . | |
| 3,643,735 | 2/1972 | Huggins | 165/172 |
| 3,800,747 | 4/1974 | Hapgood . | |
| 4,143,710 | 3/1979 | La Porte et al. | 165/182 |
| 4,453,496 | 6/1984 | Yoshinari | 122/6 A |
| 4,453,498 | 6/1984 | Juhász | 122/186 R |

FOREIGN PATENT DOCUMENTS 58-88502 5/1983 Japan .

*Primary Examiner*—Henry C. Yuen
*Attorney, Agent, or Firm*—Benasutti & Murray

[57] ABSTRACT

A multi-pipe once-through boiler having at least one row of a plurality of circumferentially arranged pipes on which a plurality of fins are arranged in such a manner that the fins are in contact with the flow of the combustion gas in a substantially parallel maner. Elements are provided for increasing the heat transfer effect, such as slits in the fins, or an inclined arrangement of the fins, or pipes without fins at the region near to the inlet of the combustion gas passageway, are provided. Furthermore, a heat insulating member for decreasing operational noise as well as a cleaner device for blow-cleaning the combustion gas passageway are provided.

13 Claims, 7 Drawing Sheets

MULTI-PIPE ONCE-THROUGH TYPE BOILER

This is a continuation of application Ser. No. 852,617, filed Apr. 16, 1986, now abandoned.

BACKGROUND OF THE INVENTION

1. Field of the Invention

The present invention relates to a multi-pipe once-through type boiler having a small volume, and used, for example, in a domestic heating device.

2. Description of the Related Art

Known in the prior art is an multi-pipe once-through type boiler provided with an inner row of circumferentially arranged pipes, an outer row of circumferentially arranged pipes, a combustion chamber inside the inner pipes, and a tubular combustion gas passageway. The inner row of pipes is provided with an inlet opening to the combustion chamber, and the outer row of pipes is provided with an outlet for connecting the tubular combustion gas passageway with a flue pipe.

The most closely related prior art is Japanese Unexamined Patent Publication (Kokai) No. 58-88502 published on May, 1983. In this prior art, the inner and outer pipes are provided with a plurality of fins to increase the efficiency, of the heat transfer from the combustion gas to water in the pipes.

Other related prior arts belonging the same applicant are Japanese Examined Utility Model Publication No. 59-41361, Japanese Unexamined Patent Publication No. 57-29000, and Japanese Unexamined Patent Publication No. 58-11303. Further related arts other than those of the applicant are; Japanese Examined Utility Model Publication No. 56-54401, Japanese Unexamined Utility Model Publication No. 52-133801, Japanese Examined Patent Publication No. 44-9161, German Patent Publication No. 2248223, and Austrian Patent Specification No. 308771. However, in view of the present demand for energy and cost saving devices, the heat transfer efficiency of the above prior arts is not satisfactory and should be improved.

SUMMARY OF THE INVENTION

Accordingly, an object of the present invention is to provide a multi-pipe once-through type of boiler having the above mentioned kind of construction, but capable of enhancing the efficiency of the heat transfer between the combustion gas in the tubular combustion gas passageway and the fluid to be heated in the pipes.

According to the present invention, a multi-pipe once-through type boiler is provided, comprising: a casing having a substantially tubular shape with a longitudinal axis; at least one row of a plurality of circumferentially arranged pipes about the longitudinal axis, each tube extending substantially in parallel to and along the axis in such a manner that a pair of spaced ends is provided, this row defining, at the inside thereof, a combustion chamber extending along the axis, the chamber being open at one end; means for generating a flow of a combustible mixture to be directed into the combustion chamber via the open end thereof, closure means for closing the other end of the combustion chamber facing the generating means; a tubular combustion gas passageway, extending along the axis and formed around the combustion chamber in such a manner that the flow of gas in the combustion chamber is in contact with at least one row of the pipes.

The tubular combustion gas passageway has an inlet extending along substantially the entire length thereof along the axis for introduction of the combustion gas from the combustion chamber and the tubular combustion gas passageway also has an outlet extending along substantially the entire length thereof along the axis for removing the combustion gas from the passageway.

A flue means is connected to the outlet for removing the combustion gas to the outside; a first header is connected to the casing, the pipes in the casing being, at their first end, connected to the first header so that communication of a fluid to be heated is attained therebetween; a second header is axially spaced from the first header, the pipes in the casing being, at their second ends, connected to the second header so that communication of the fluid to be heated is attained therebetween.

A plurality of fins is formed on substantially the entire portions of the outer surfaces of the pipes in such a manner that the fins are in contact with the flow of the combustion gas in the combustion gas passageway, each of the fins extending substantially in the direction of the flow of the heating gas, and a means for improving the heat transfer efficiency between the heating gas in the combustion gas passageway and the tubes through which the fluid to be heated is passed.

DESCRIPTION OF THE PREFERRED EMBODIMENTS

Figure 1:
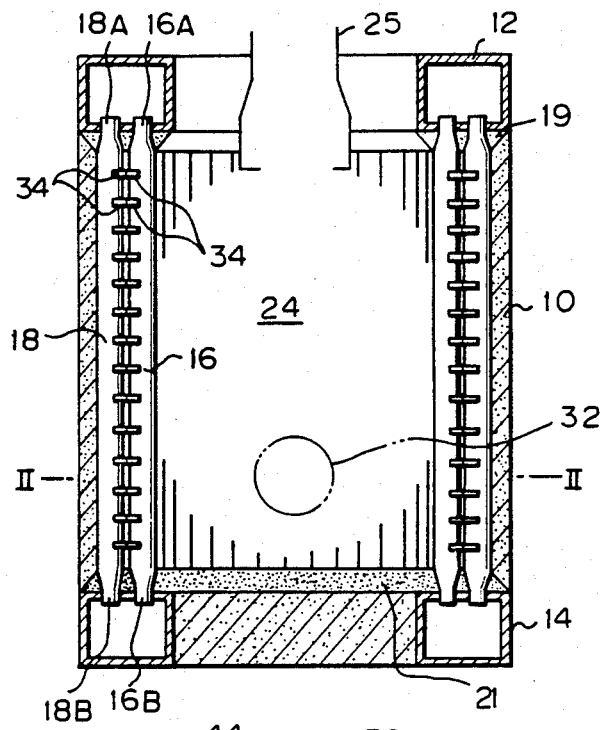
FIG. 1 shows a longitudinal cross sectional view of a two-row type boiler according to the present invention.

FIG. 1 illustrates a vertical cross-sectional view of an embodiment of an once-through type boiler according to a first embodiment of the present invention. In FIG. 1, reference numeral 10 denotes a cylindrical casing, and an upper annular header 12 and lower annular header 14 are arranged on the upper and the lower ends of the casing 10, respectively. A row of inner pipes 16 are arranged circumferentially in the casing 10, each of the inner pipes 16 extending in parallel to the axis of the tubular casing 10 and providing an upper end 16A and lower end 16B, respectively, having a reduced diameter A second row of outer pipes 18 are also arranged circumferentially in the casing 10, so that the first row of inner pipes 16 and the second row of outer pipes 18 are coaxial with respect to the axis of the casing 10.

Figure 2:
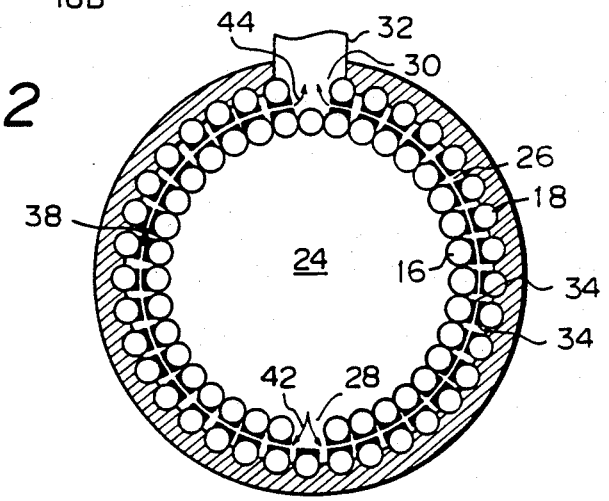
FIG. 2 is a cross-sectional view taken along the line II—II of FIG. 1.
Figure 3:
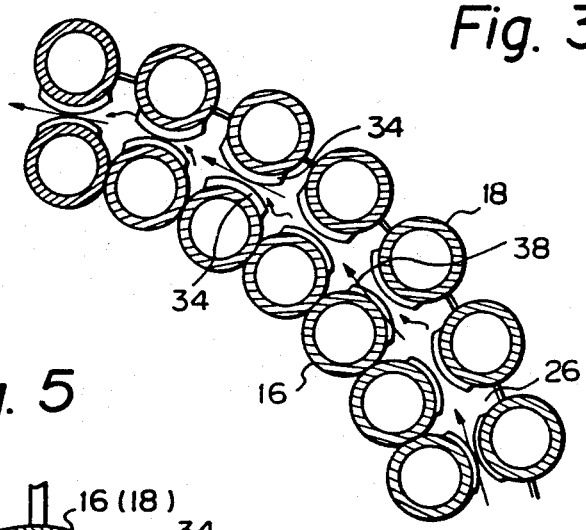
FIG. 3 partially shows an arrangement of the inner and outer pipes.

Each of the outer pipes 18 extends in parallel to the axis of the casing, and provides an upper and a lower end 18A and 18B, respectively, having a reduced diameter. The upper ends 16A and 18A of the rows of inner pipes 16 and outer pipes 18 are connected, via a filler layer of heat resistant material 19, to the upper header 12 in such a manner that the header 12 is in communication with the pipes 16 and 18. The lower ends 16B and 18B of the inner pipes 16 and outer pipes 18 are connected, via filler layer of heat resistant material 21, to the bottom header 14 in such a manner that the header 14 is in communication with the pipes 16 and 18. As shown in FIG. 2, the inner pipes 16 are arranged in such a manner that two adjacent inner pipes 16 are in contact with each other at their geometric lines, and the outer pipes 18 are arranged so that two adjacent pipes 18 are circumferentially spaced. As a result, two adjacent pipes in both of the inner and outer rows 16 and 18 are arranged at the same angular interval in such a manner that each adjacent pair of the inner and outer pipes 16 and 18 is located on the same radial plane. In order to obtain the angularly spaced arrangement of the outer pipes 18, the inner surface of the casing 10 is formed with a plurality of axially extending and circumferentially spaced grooves in which the corresponding outer pipes 18 are arranged As is well known, water is supplied to the bottom header 14 by way of a water supply system (not shown) in such a manner that water in the inner and outer pipes 16 and 18 is maintained at a predetermined level Therefore, vapor generated in the pipes 16 and 18 due to the heat exchange occurring between the combustion gas and water is directed upward so as to fill the upper header 12.

A combustion chamber 24 is formed inside the row of inner pipes 16 and extends axially thereto The combustion chamber 24 is open at the upper end thereof, and the bottom end thereof is closed by the heat resistant material layer 21. A burner 25 is arranged in the upper open end of the combustion chamber 24 opposite the closed bottom 21 of the combustion chamber 24 The burner 25 per se is known, and is constructed, for example, by a fuel nozzle (not shown) encircled by an air tube connected to a forced air flow source, so that the burner 25 produces a flow of combustible mixture which is injected into the combustion chamber 24 and burnt therein Alternately, the burner 25 may be arranged in a space formed inward of the lower header 14 In this case, the upper end of the combustion chamber 24 is, of course, closed.

A combustion gas passageway 26 having an annular shape is formed between the inner row of pipes 16 and the outer row of pipes 18 so that the chamber 24 extends along substantially the entire length of the pipes 16 and 18. As shown in FIG. 2, the arrangement of the inner pipes 16 is interrupted at a position in the circumference of the row of pipes 16 in such a manner that an inlet 28 extending along the entire length of the combustion chamber 24 is formed, to allow communication between the combustion chamber 24 and the combustion gas passageway 26. Similarly, the arrangement of the outer pipes 18 is interrupted at a position in the circumference of the row in such a manner that an outlet 30 extending along the entire length of the combustion chamber 24 is formed, to allow the gas in the passageway 26 combustion gas to be exhausted therefrom. A flue pipe 32 is connected to the casing 10 and communicates with the outlet 30 for exhausting the combustion gas to the atmosphere.

As shown in FIGS. 1 and 2, each of the inner and outer pipes 16 and 18 has a plurality of axially spaced fins 34 welded to the pipes 16 and 18. Each of the fins 34 extends outwardly and radially from the tubular surface of the corresponding pipe 16 or 18, so that the heating gas or combustion gas in the combustion passageway 26 flows as shown by an arrow 38 in parallel to the fins 34. The fins 34 on the inner pipes 16 are arranged in such a manner that they face the corresponding fins 34 of the corresponding outer pipes 18 in the same place.

Figure 5:
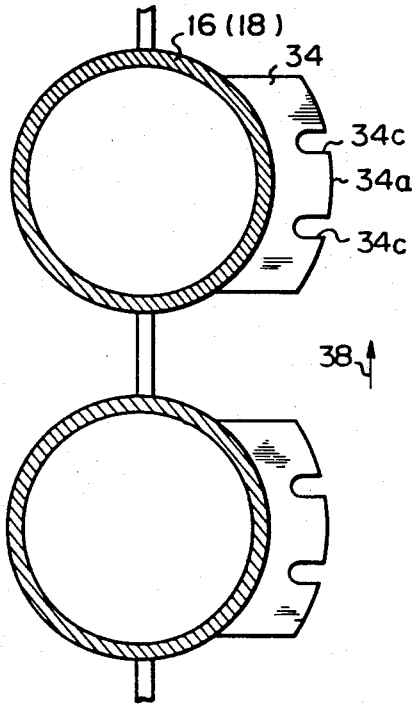
FIG. 5 is a lateral and enlarged cross-sectional view of pipes provided with fins having slits.

As shown in FIG. 5, each of the fins 34 forms a plate extending vertically from the cylindrical surface of the corresponding pipe 16 (18) in a cantilever fashion, so that arc shaped peripheral 34*a* and straight side edges 34*b* connected therewith are formed. Furthermore, the fin 34 forms slits 34*c* extending inward and substantially radially from the arc shaped peripheral edge 34*a* in a direction which is substantially transverse to the direction of flow of the heating gas, as shown by the arrow 38, in the combustion gas passageway 26.

During the operation of the first embodiment of the present invention, the combustible mixture from the burner 25 is injected into the combustion chamber 24 to be burnt therein. Water in the inner pipes 16 is heated due to a heat exchange based on the radiation heat transmission principle. Then, the resultant combustion gas or heating gas in the combustion chamber 24 is, via the inlet 28, introduced into the combustion gas passageway 26 as shown by an arrow 42 in FIG. 2, to generate a flow of the combustion gas in the combustion gas passageway 26 in the direction substantially transverse to the longitudinal direction of the inner pipes 16 and outer pipes 18. As a result, a heat exchange takes place between the water in the pipes 16 and 18 and the combustion gas in the combustion gas passageway 16 via the walls of the pipes 16 and 18 and the fins 34, mainly under the convection heat transmission principle. The combustion gas is then exhausted into the flue pipe 32 via the outlet 30 as shown by arrows 44. Viewed from above, as shown in FIG. 2, the flow of the combustion gas in the combustion gas passageway 26 from the inlet 28 to the outlet 30, as shown by the arrows 42 and 44, depicts a shape which is similar to the Greek letter δ

Accordingly, this system is often called the "omega" flow type system.

Figure 4:
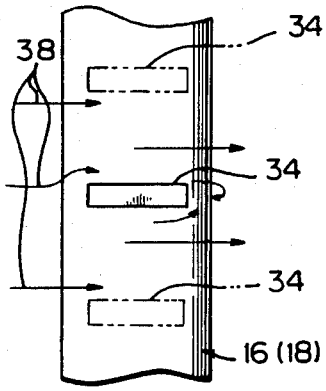
FIG. 4 is a partial and enlarged side elevational view of a pipe provided with fins.

The multiplicity of the fins 34 on the pipes 16 and 18 does not cause any substantial increase in pressure drop when the combustion gas passes through the combustion gas passageway 26 from the inlet 28 to the outlet 30, since the fins 34 are arranged so that they are in parallel to the flow, shown by the arrow 38, of the combustion gas, as shown in FIG. 4. In addition, as shown in FIG. 5, each of the fins 34 is provided with slits 34*c* extending radially inwardly from the edges 34*a* in the direction transverse to the direction of the flow of the combustion gas. Thus, a so-called front edge effect in a convection heat transfer is attained, and thus the efficiency of the heat transfer is enhanced Furthermore, the difference in the degree of heat expansion between the fins 34 and the pipes 16 and 18 due to the temperature difference therebetween is compensated by the slits 34*c* in the fins 34, so that the generation of thermal stress in the welded regions of the fins 34 to the pipes 16 and 18, which would otherwise generate cracks or deformation, is eased.

Figure 6:
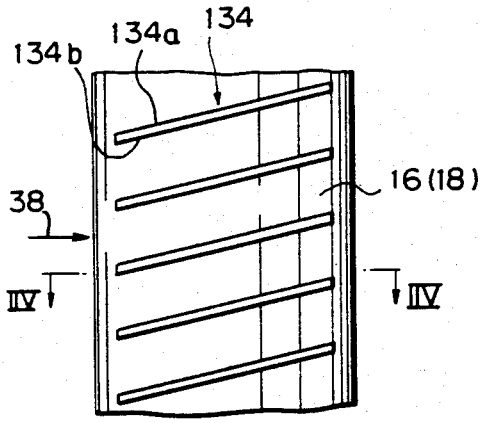
FIG. 6 show fins in an inclined arrangement on a pipe.

FIG. 6 shows a modification of the arrangement of the fins 134. In this modification, each of the fins 34 is constructed by a plate having a pair of axially spaced parallel planes 134*a* and 134*b* which are more or less inclined with respect to the direction of the flow of the combustion gas in the combustion gas passageway 6, as shown by the arrow 38.

Due to the fact that the inclination of the fins 34 with respect to the direction of the flow of the combustion gas in the combustion gas passageway 26 is small, the pressure loss occurring across the combustion gas passageway 26 becomes small even if a multiplicity of fins 134 are employed Furthermore, since the fins 134 are inclined with respect to the direction of the flow of the combustion gas, the gas flow along the fins 134 serves to strip the temperature boundary layers of the combustion gas formed in the proximity of the surfaces of the fins 134 by the viscosity of the gas, so that turbulence is generated in the temperature boundary layers, enhancing the heat transfer efficiency.

Figure 8:
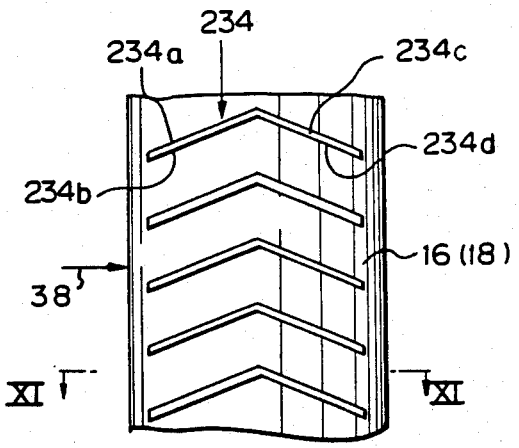
FIG. 8 is another modification of the inclined arrangement of fins on a pipe.
Figure 7:
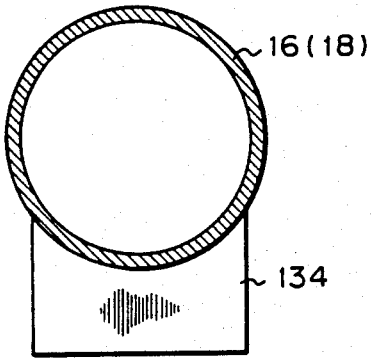
FIG. 7 is cross-sectional view taken along the line IIV—IIV in FIG. 6.
Figure 9:
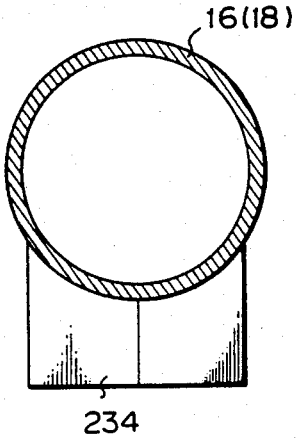
FIG. 9 is a cross-sectional view taken along the line XI—XI in FIG. 8.

In a modification shown in FIGS. 8 and 9, fins 234 of different shapes are provided on the pipes 16 and 18. Each of the fins 234 forms a plate having a pair of axially spaced parallel first planes 234*a* and 234*b* which are inclined toward the direction of the flow of the combustion gas (arrow 38) and a plate having pair of axially spaced parallel second planes 234*c* and 234*d* which are inclined toward the opposite direction of that of the first planes 234*a* and 234*b*.

In the embodiment shown in FIGS. 8 and 9, as the combustion gas passes each of the fins 234, turbulence of the temperature boundary layers formed in the proximity of the fins 234 is repeatedly attained due to the provision of the inclined first planes 234*a* and 234*b* and the oppositely inclined second planes 234*c* and 234*d*. As a result, an increased heat transfer efficiency is attained.

Figure 10:
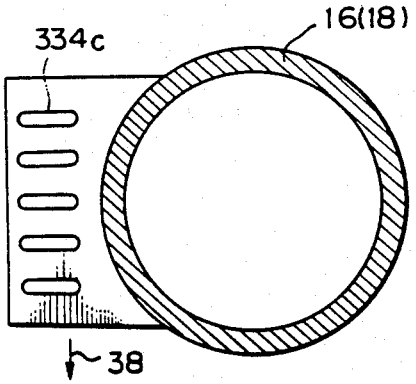
FIG. 10 is a cross-sectional view of a pipe with a modified fin.

FIG. 10 shows another modification of the shape of a fin. In this modification, the fin 334 forms a plate provided with a plurality of parallel closed end slits 334*c*, each of which extends in a direction traverse to the direction of the flow of the heating gas, as shown by an arrow 38. Similar to the embodiment shown in FIG. 5, the provision of the slits 234*c* serves to generate the so-called front edge effect in a convection heat transfer, enhancing the efficiency of the heat transmission.

Figure 11:
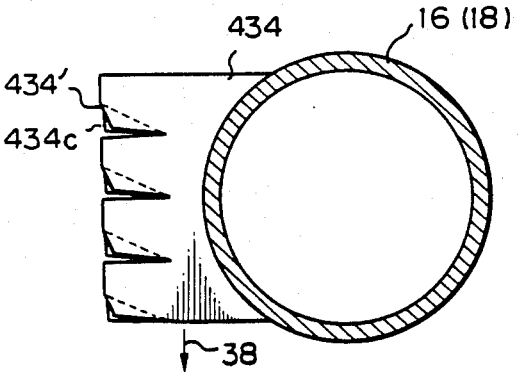
FIG. 11 is a cross-sectional view of a pipe with another modified fin.

FIG. 11 shows a further embodiment of the shape of a fin. In this modification, the fin 434 is located at regions near the outer edge thereof and has a plurality of portions 434' having a triangular shape which are bent slightly from the general plane of the fin 434 so that a plurality of slits 434*c* open outwardly to extend in the direction transverse to the direction of the flow of the heating gas in the combustion gas passageway 26, as shown by the arrows 38, are formed between the bent portions and the facing edges. The "front edge effect" is provided due to the provision of the slits in the boundary layers formed in the regions near to the surfaces of the pipes 16 and 18, so that heat transfer efficiency is enhanced. Furthermore, the portions 434' are only slightly bent, and therefore, a substantial pressure loss can not occur.

Figure 12:
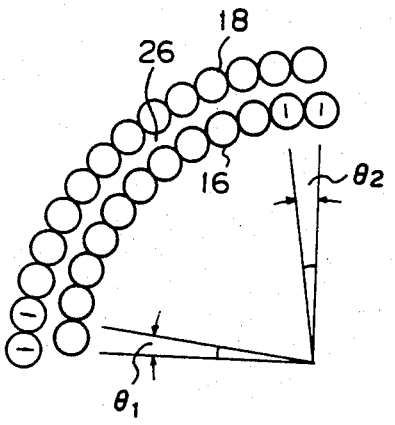
FIG. 12 shows an arrangement of inner and outer pipes which are directly connected to each other.
Figure 13:
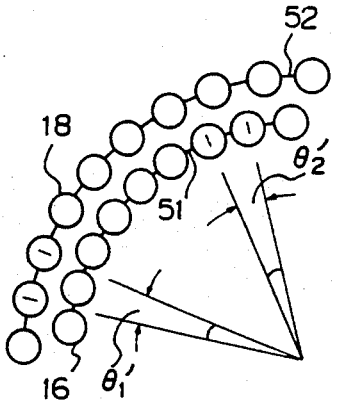
FIG. 13 shows an arrangement of inner and outer pipes which are spaced by respective spacers.

FIGS. 12 and 13 show two alternatives in obtaining the arrangement of the inner row of the pipes 16 and the outer row of the pipes 18. In FIG. 12, in both the inner and outer rows of pipes, the adjacent pipes 16 and 18 are arranged so that they are in direct contact with each other at their geometric lines, so that the combustion gas passageway 26 is formed between the inner pipes 16 and the outer pipes 18. In this case, the angle $\theta_1$ between the adjacent two outer pipes 18 in the outer row becomes smaller than the angle $\theta_2$ between the adjacent two inner pipes 16 in the inner row.

Figure 14:
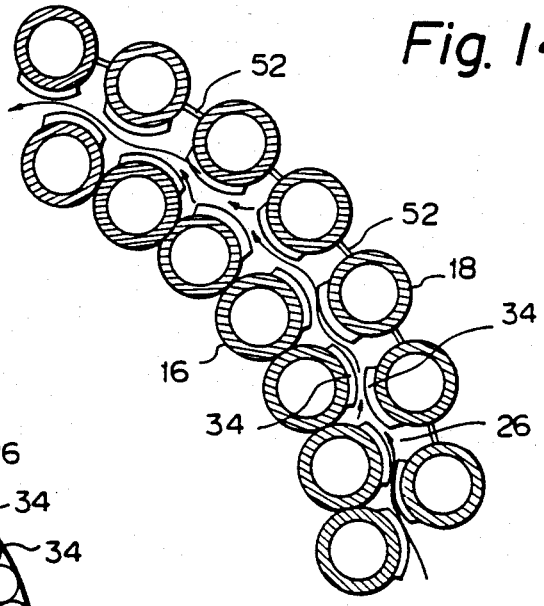
FIG. 14 shows an modified arrangement of alternate inner and outer rows of the pipes.

In FIG. 13, spacers 51 are arranged between every two adjacent pipes 16 in the inner row while spacers 52 are arranged between every two adjacent pipes 18 in the outer row, in such a manner that an angle $\theta_1'$ between the adjacent outer pipes 18 is equal to an angle $\theta_2'$ between the adjacent pipes 16, and in such a manner that the inner and outer pipes 16 and 18 are alternately arranged in the circumferential direction. In this arrangement, the length of the outer spacer 52 is, of course, larger than the length of the inner spacer 51. This alternate arrangement of the inner and outer pipes 16 and 18 with the same angular distance ($\theta_1=\theta_2$) is also attained without the use of the inner spacers, as shown in FIG. 14. In the alternate arrangement of the inner and the outer pipes 16 and 18 as shown in FIGS. 13 and 14, the combustion gas passageway 26 is provided with a substantially uniform width, and a flow of combustion gas having a direction which is slightly and periodically changed along the circumferential direction is obtained. This periodical change in the flow direction gives an increase in the efficiency in the heat transfer, without increasing the pressure loss generated when the combustion gas passes through combustion gas passageway 26.

The provision of the spacers 51 and 52 between adjacent pipes allows a smooth flow of the combustion gas in the combustion gas passageway 26, preventing the generation of dead spaces between the adjacent pipes, in which the combustion gas is apt linger out of the general flowstream, giving a higher interior efficiency in the heat transfer.

Figure 15:
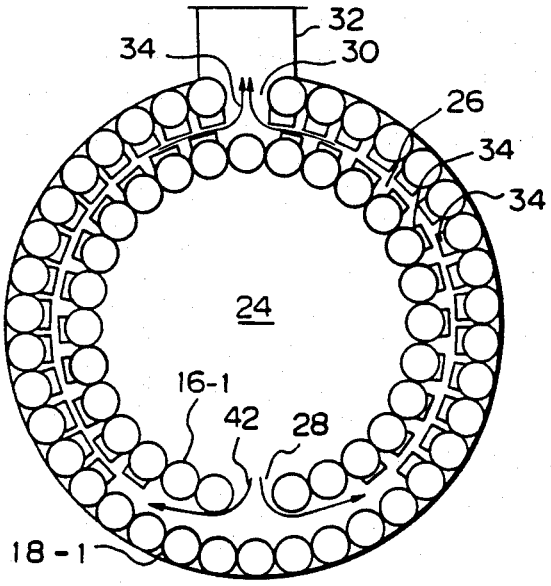
FIG. 15 shows a cross-sectional view similar to FIG. 2 in an embodiment provided with pipes having no fins at the inlet.

FIG. 15 shows another embodiment, wherein the inner row of pipes 16 and outer row of pipes 18 are provided with fins 34 except at regions near the inlet 28. The temperature of the combustion gas just after it is introduced from the combustion chamber 24 into the combustion gas passageway 26 via the inlet 28, is high enough to cause a large temperature difference between the fins 34 and the corresponding pipes, which would generate cracks in the pipes 16 and 18 if the fins 34 were provided. In this embodiment, the pipes 16-1 and 18-1 near the inlet 28 are not provided with fins, and thus the temperature difference is decreased which decreases the chance of crack generation Furthermore, because the fins 34 are not provided on the pipes 16-1 and 18-1 near the inlet 28, a predetermined heat transfer efficiency is maintained without change even over a prolonged period of operation, since there are no fins 34 on the pipes 16-1 and 18-1 to be eroded by the high temperature of the combustion gas. It should be noted that, at the regions where the combustion gas passageway 26 is spaced from the inlet 28, the temperature of the combustion gas is decreased due to the heat convection at the regions where the pipes 16 and 18 are not provided with fins 34, i.e., near the inlet, and therefore, the problem of thermal corrosion of the fins 34 does not arise.

Figure 16:
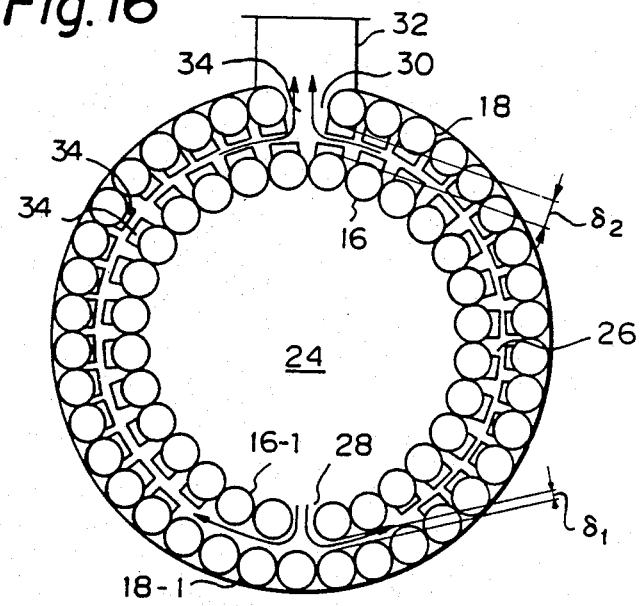
FIGS. 16 and 17 are similar to FIG. 15 but directed to further embodiments, respectively.

In the embodiment shown in FIG. 16, the inner row of pipes 16 and the outer row of pipes 18 are slightly eccentrically arranged in such a manner that the distance $\delta_1$ between the facing inner and outer pipes 16 and 18 at the inlet 28 is smaller than the distance $\delta_2$ between the facing inner and outer pipes 16 and 18 at the outlet 30. As a result, the combustion gas passageway 26 is throttled at the inlet 28 to increase the speed of the combustion gas and thus increase the heat transfer rate at the region near the inlet 28. Thus, the heat transfer effect attained by the pipes 16-1 and 18-1 without fins can be equal to the heat transfer effect attained by the pipes 16-1 and 18-1 with fins. The pressure drop generated when the combustion gas passes through the combustion gas passageway 26 at the region where the pipes are without fins is, of course, correspondingly increased. However, the pipes 16-1 and 18-1 extend along a limited area near the inlet 28, so that there is no adverse effect caused by the throttling of the combustion gas passageway 26, and a sufficient flow of the combustion gas is obtained to maintain a stable operation of the boiler. Furthermore, due to the throttling of the combustion gas passageway 26, at the inlet 28, uniform distribution of the combustion gas along the entire axial length of the combustion gas passageway 26 is obtained, allowing the combustion gas to evenly come into contact with the entire surface of fins 34, to increase the heat transfer efficiency and to prevent the pipes from local overheating for preventing the generation of cracks in the pipes 16-1 and 18-1.

In the arrangement of FIGS. 15 and 16, the outer pipes 18-1 without fins 34 extend further downstream in the direction of the flow of the combustion gas in the combustion gas passageway 26 than the inner pipes 16-1 without fins 34. Since they are submitted to the heat from the combustion chamber 24, the temperature difference between the combustion gas and the inner pipes 16-1 is smaller than the temperature difference between the combustion gas and the outer pipes 18-1 which are spaced further from the combustion chamber 24. Therefore, the limited extension arrangement of the pipes 16-1 without fins 34 maintains a lower possibility of the generation of cracks in the welded regions of the fins 34 to the pipes 16-1, and the heat transfer efficiency is increased by this arrangement.

Figure 17:
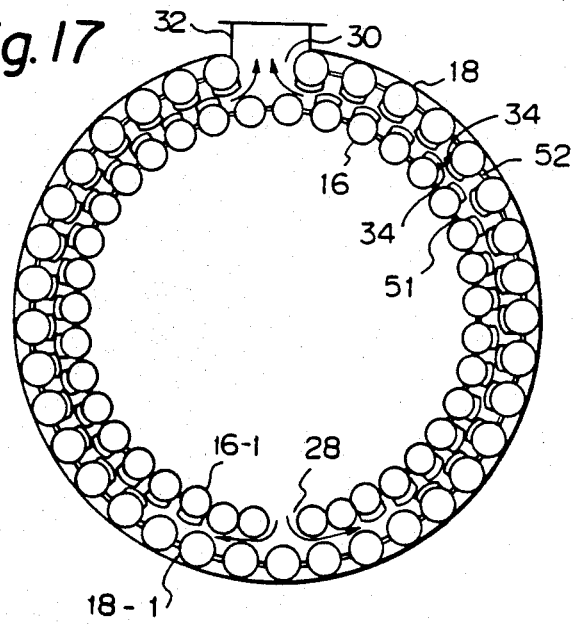

FIG. 17 shows a modification wherein the pipes 16-1 and 18-1 without fins 34 in FIGS. 15 and 16 are combined with the alternate arrangement of the inner and the outer pipes shown in FIG. 13, by the provision of the spacers 51 and 52.

Figure 18:
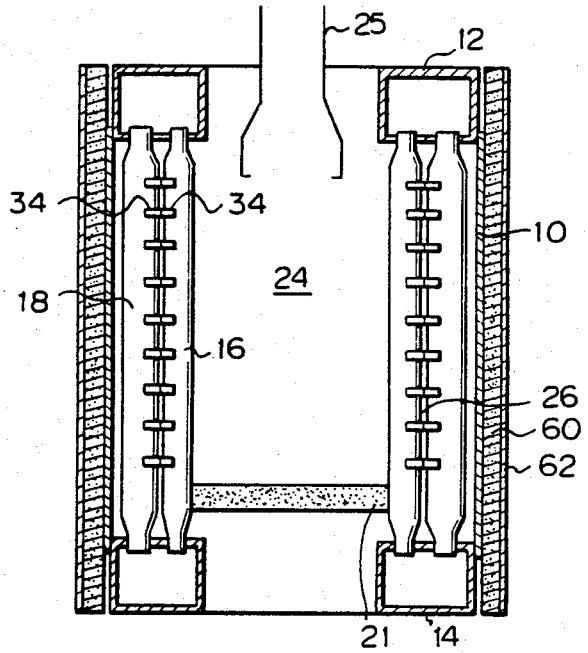
FIG. 18 is a longitudinal cross sectional view of a boiler in a further embodiment and provided with a heat insulation.

In FIG. 18, in addition to the essential constituent members as already described, the boiler is provided with elements for maintaining the temperature therein and for decreasing the operational noise. In this embodiment, a layer 60, made from a heat resisting material such as glass wool, is arranged outside the casing 10. The heat resisting layer 60 is held in place by an outer tubular cover 62 made from a thin metal plate. The provision of the heat resisting material layer 60 covered by the plate 62 prevents heat loss and suppresses operational noise In this embodiment shown in FIG. 18, the bottom plate 21 made of a heat resistant filler material is spaced from the lower header 24 in such a manner that the plate 21 is in contact with the inner periphery of the inner row of pipes 16.

Figure 19:
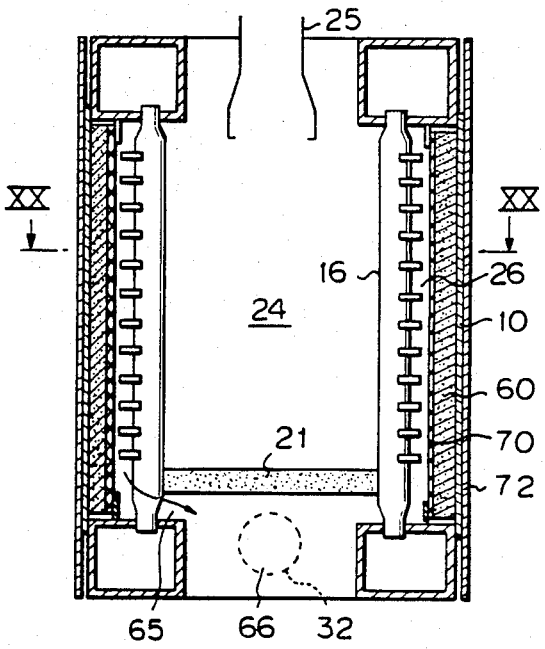
FIG. 19 shows another embodiment of a boiler with a single row arrangement of pipes.
Figure 20:
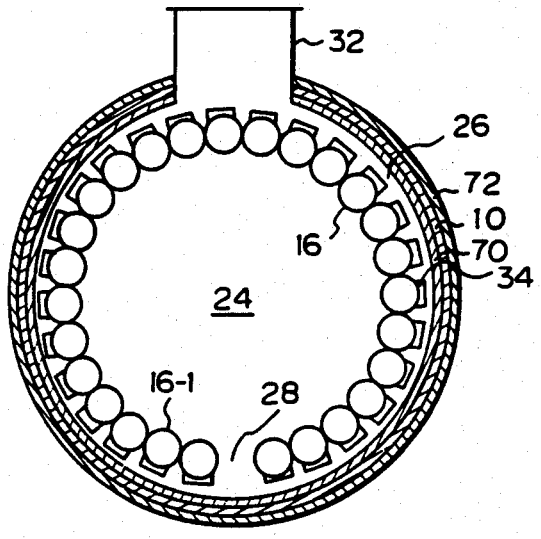
FIG. 20 is a cross-sectional view taken along the line XX—XX in FIG. 19.

In an embodiment shown in FIGS. 19 and 20, the boiler is provided with a single row of pipes 16 arranged circumferentially in such a manner that the combustion chamber 24 is formed inside the row of pipes 16. The combustion chamber 24 is open at the upper end and a burner 25 is arranged therein. The bottom end of the combustion chamber 24 is formed by the layer 21 of the heat resistant filler material. A combustion gas passageway 26 is formed between the row of pipes 16 and the casing 10. The row of pipes 16 is provided with an inlet 28 extending axially, through which the combustion gas from the combustion chamber 24 is introduced into the combustion gas passageway 26. The combustion gas from the combustion gas passageway 26 is introduced into a space 66 formed below the plate 21 via a slit 65 formed at the bottom between the pipes 16 and exhausted from the flue pipe 32.

In this embodiment, the pipes 16 also are provided with fins 34 on substantially the entire length and width thereof. Each of the fins 34 is arranged substantially parallel to the flow of the combustion gas in the combustion gas passageway 26. Furthermore, each of the fins 34 is provided with means for increasing the heat transfer efficiency, similar to the slits shown in FIG. 5, or have an inclined arrangement as shown in FIGS. 6 to 9, or are provided with slits as shown in FIGS. 10 or 11.

Furthermore, in the embodiment shown in FIG. 19, the heat resisting layer 60 is arranged inside the casing 10, and an inner plate 70 made of a perforated plate, such as a punched plate, is arranged inside the layer 60 of heat resisting material. Due to the provision of the perforated plate 64, a high noise suppression effect is obtained. Furthermore, since the combustion gas can act directly on the heat resisting material layer 60, via the perforated plate, the temperature in the boiler is effectively maintained without heat loss. The casing 10 is covered by an outer cover 72. It should be noted that this construction of the heat resisting coating can be also applied to the two row arrangement of pipes as explained with reference to FIGS. 1 to 18.

Figure 21:
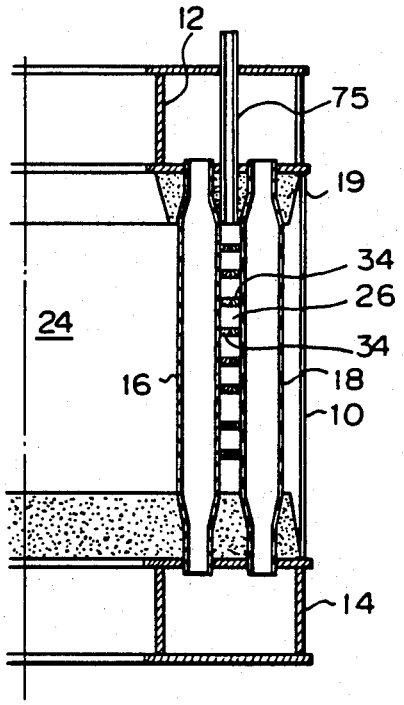
FIG. 21 is a partial longitudinal cross-sectional view of a boiler in a further embodiment of the present invention and provided with a cleaner guide pipe.

In FIG. 21, the two row type boiler, in addition to the essential constituent members as already explained, is provided with guide pipes 75 (one of which is shown in the drawing), to allow the introduction of a nozzle for blowing-out the boiler for cleaning purposes. Each of the guide pipes 75 is connected, in this embodiment, to the upper header 12 so that it passes through the header 12 and the heat resistant material layer 19 attached to the bottom surface thereof. The pipe 75 is opened at its bottom end to the combustion gas passageway 26.

When the boiler is to be cleaned, high pressure cleaner devices provided with tip nozzles are inserted in the upper ends of the respective guide pipes 75, and high pressure water is ejected from the nozzles while they are moved downward or upward. It should be noted that the nozzles are arranged so that horizontal jets of water are ejected therefrom.

Figure 22:
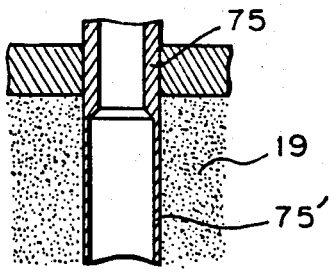
FIG. 22 shows an enlarged view of a portion of the cleaner guide in a modification of FIG. 21.

FIG. 22 shows a modification of the arrangement of the guide pipe 75, wherein a portion 75' of the guide pipe 75 surrounded by the heat resistant material layer 19 is thin-walled. The high temperature of the combustion gas acts mainly on the thin wall portion so that it is gradually burnt. Therefore, the portion of the guide pipe 70 in the upper tank 12 is maintained free from thermal damage.

It should be noted that this cleaner nozzle arrangement can be also applied to the single row arrangement shown in FIG. 19.

Although embodiments and modifications of the present invention are described with reference to the attached drawings, many other changes may be made by those skilled in this art without departing from the scope and spirit of the present invention.

We claim:

1. A multi-pipe once-through type boiler, comprising:

a case having a substantially tubular shape with a longitudinal axis;

at least one row of a plurality of circumferentially arranged piped around said longitudinal axis, each pipe extending substantially in parallel to along said axis so as to define one wall of an annular passage and to provide a pair of spaced ends;

said row defining, at the inside thereof, a combustion chamber extending along said axis, said chamber being open at one end;

means for generating the flow of a combustible mixture to be directed into the combustion chamber via said open end of said chamber;

closure means for closing the other end of the combustion chamber facing the flow generating means;

a combustion gas passageway through said annular passage, which extends along said axis and is formed around the combustion chamber and in contact with the at least one row of pipes;

said combustion gas passageway having an inlet extending along substantially the entire length thereof along said axis for introduction of the combustion gas from the combustion chamber;

said combustion gas passageway having an outlet extending along substantially the entire length thereof along said axis for removing the combustion gas from the passageway wherein the combustion gas travel an arcuate path through said annular passageway from said inlet to said outlet;

flue means connected to the outlet for the removing of the combustion gas to the outside;

a first header connected to the casing, the pipes being, at their first end, connected to the first header so that communication of fluid to be heated is attained therebetween;

a second header axially spaced from the first header, the pipes being, at their second ends connected to the second header so that a communication of the fluid to be heated is attained therebetween;

a plurality of fins each extending into said gas passageway radially in a cantilever fashion formed on substantially the entire length of the outer surfaces of the pipes in such a manner that said fins extend perpendicular to said pipe surfaces in contact with the flow of the combustion gas in the combustion passageway, each of said fins having a plate shape extending substantially parallel to the direction of the flow of the heating gas, each of said fins having a plate shape defining opposite parallel edges extending substantially transversely to the flow of the heating gas wherein a leading edge of said fins is substantially perpendicular to the flow and extends the entire perpendicular length of the fin from the surface of the pipe; and wherein each of said fins forms a plate shape extending substantially transverse to the axis of the corresponding pipes so as to define an outer edge, and each of said fins having at least one slit formed, each slit extending inwardly with respect to the outer edge so as to have two space apart slit edges of a single slit, which edges are substantially parallel with respect to the opposite side edges of the fin wherein said two space apart slit edges of said single slit are substantially parallel to the flow of said heating gas, so that a front edge effect is generated by the opposite side edges and said two spaced apart parallel edges of each of the slits to which the combustion gas is contacted thereby enhancing heat transfer efficiency.

2. A boiler according to claim 1, wherein a first inner and a second outer row of pipes are provided so that said inner first and outer second rows are substantially concentric with respect to the longitudinal axis, and wherein said combustion gas passageway is formed between said first inner row of pipes and said second outer row of pipes.

3. A boiler according to claim 1, wherein the length of said leading edge of said slit is in the range of one-third to one-half the width of said fin.

4. A boiler according to claim 1, wherein the length of said fin along the direction of the flow of said combustion gas is substantially equal to the diameter of said pipe.

5. The boiler according to claim 1, wherein a single row of pipes is provided and said fins are deposed on one side of said combustion gas passageway.

6. The boiler according to claim 1, wherein more that two rows of pipes are provided and said fins are deposed on both sides of said gas passageway.

7. A multi-pipe once-through type boiler, comprising:

a casing having a substantially tubular shape with a longitudinal axis;

at least one row of a row of circumferentially arranged pipes about said longitudinally axis, each pipe extending substantially parallel to and along said axis so as to define one wall of an annular passageway and provide a pair of spaced ends;

said row defining, at the inside thereof, a combustion chamber extending along said axis, said chamber being open at one end;

means for generating a flow of a combustible mixture to be directed into the combustion chamber via said open end of said chamber;

closure means for closing the other end of the combustion chamber facing the flow generating means;

a combustion gas passageway through said annular passage, which extends along said axis and is formed around the combustion chamber so that the flow of the combustion chamber is in contact with the at least one row of pipes;

said combustion gas passageway having an inlet extending along the substantially entire length thereof along said axis for introduction of the combustion gas from the combustion chamber;

said combustion gas passageway having an outlet extending along the substantially entire length thereof along said axis for removing the combustion gas form the passageway wherein the combustion gas travel an arcuate path through said annular passageway from said inlet to said outlet;

flue means connected to the outlet for removing the combustion gas to the outside;

a first header connected to the casing, the pipes being, at their first end, connected to the first header so that a communication of fluid to be heated is attained therebetween;

a second header axially spaced from the first header, the pipes being, at their second ends, connected to the second header so that a communication of the fluid to be heated is attained therebetween;

a plurality of individual fins each extending into said gas passageway radially in a cantilever fashion and formed on the substantially entire portions of the outer surfaces of the pipe in such a manner that said fins extend perpendicular to said pipe surfaces in contact with the flow of the combustion gas in the combustion passageway, each of said fins having a plate shape defining opposite edges extending substantially transversly to the flow of the heating gas wherein a leading edge of said fins is substantially perpendicular to the flow, and extends the entire perpendicular length to the fin from the surface of a pipe, and each of said fines forming a plate shape extending substantially transverse to the axis of the corresponding pipes so as to define an outer edge, and each of said fins having at least one slit formed thereon, each slit extending inwardly with respect to the outer edge so as to have two spaced apart slit edges of a single slit, which edges are substantially parallel with respect to the opposite side edges of the fin wherein said two spaced part slit edges of said single slit are perpendicular to the flow said opposite side edges and said two spaced apart parallel edges of each of the slits to which the combustion gas is contacted thereby enhancing heat transfer efficiency; and, each of said fins further forming a plane slightly inclined with respect to the direction of flow of the heating gas in the passageway.

8. A boiler according to claim 7, wherein a first inner and a second outer row of pipes are provided so that said inner first and outer second rows are substantially concentric with respect to the longitudinal axis, and wherein said combustion gas passageway is formed between said first inner row of pipes and said second outer row of pipes.

9. A boiler according to claim 7, wherein each of the fins additionally forms, following the first plane, a second plane oppositely and slightly inclined with respect to the direction of flow of the combustion gas.

10. The boiler according to claim 1, wherein the length of said leading edge of said slit is in the range of one-third to one-half the width of said fin.

11. The boiler according to claim 7, wherein the length of said fin along the direction of the flow of said combustion gas is substantially equal to the diameter of said pipe.

12. The boiler according to claim 7, wherein a single row of pipes is provided and said fins are deposed on one side of said combustion gas passageway.

13. The boiler according to claim 7, wherein more than two rows of pipes are provided and said fins are disposed on both sides of said gas passageway.

* * * * *